US009375918B2

(12) United States Patent
Hanagami et al.

(10) Patent No.: US 9,375,918 B2
(45) Date of Patent: Jun. 28, 2016

(54) INK JET PRINTER AND CONTROL METHOD THEREFOR

(71) Applicant: Seiko Epson Corporation, Shinjuku-ku (JP)

(72) Inventors: Taiki Hanagami, Matsumoto (JP); Junichiro Matsushita, Matsumoto (JP); Takeo Seino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/749,457

(22) Filed: Jun. 24, 2015

(65) Prior Publication Data

US 2015/0375502 A1 Dec. 31, 2015

(30) Foreign Application Priority Data

Jun. 25, 2014 (JP) ..... 2014-129987

(51) Int. Cl.
*B41J 2/045* (2006.01)

(52) U.S. Cl.
CPC ..... *B41J 2/04551* (2013.01); *B41J 2/0459* (2013.01); *B41J 2/04581* (2013.01); *B41J 2/04588* (2013.01)

(58) Field of Classification Search
None
See application file for complete search history.

(56) References Cited

U.S. PATENT DOCUMENTS 6,293,663 B1 * 9/2001 Koshikawa ..... B41J 2/17513 347/86
2005/0018009 A1 * 1/2005 Otsubo ..... B41J 2/16523 347/36
2011/0050766 A1 * 3/2011 Matsumoto ..... B41J 2/17509 347/7

FOREIGN PATENT DOCUMENTS

JP 08-183170 A 7/1996
JP 2000-127431 A 5/2000

* cited by examiner

*Primary Examiner* — Justin Seo
(74) *Attorney, Agent, or Firm* — Kilpatrick Townsend & Stockton LLP

(57) ABSTRACT

An ink jet printer includes an attachment detection portion that detects an attachment of an ink storage member that retains an ink in an absorber contained in the ink storage member itself; an ink jet recording head that ejects an ink flown in from the ink storage member; and a control circuit that controls ink ejection performed by the ink jet recording head. The control circuit is configured to, upon detection, by the attachment detection portion, of an attachment of the ink storage member to be newly used, perform control so as to cause a first operation mode to be set, and thereafter, perform control so as to cause the first operation mode to be switched to a second operation mode, upon satisfaction of a condition in that a total discharge amount of an ink ejected in the first operation mode reaches a prescribed amount. Further, a per-unit-time discharge amount of an ink ejected in the first operation mode is set so as to be smaller than a per-unit-time discharge amount of an ink ejected in the second operation mode.

2 Claims, 7 Drawing Sheets

INK JET PRINTER AND CONTROL METHOD THEREFOR

CROSS REFERENCE TO RELATED APPLICATIONS

This application claims priority under 35 U.S.C. §119 to Japanese Patent Application No. 2014-129987 filed Jun. 25, 2014, the entire disclosures of which are expressly incorporated by reference herein.

BACKGROUND

1. Technical Field

The present invention relates to ink jet printers and control methods therefor and, more particularly, an ink jet printer using an ink storage member that contains an absorber for absorbing and retaining an ink, and a control method therefor.

2. Related Art

An ink jet printer which belongs to a kind of ink jet printer is an apparatus that includes a permanent head and causes liquids of various kinds to be ejected (discharged) from the permanent head. This ink jet printer is a non-impact printing apparatus that forms characters on paper by ejecting particles or droplets of inks onto the paper (JIS X0012-1990). This ink jet printer is one of various forms of dot printers, this dot printer being a printer that performs printing of characters and/or images, each of the characters and images being represented by a plurality of dots (JIS X0012-1990), and the ink jet printer performs printing of such characters and/or images, each of the characters and images being represented by a plurality of dots, by forming the dots through a method of ejecting particles or droplets of inks. Further, the permanent head is a portion that includes mechanical and electric portions inside a printer body and that successively or intermittently generates liquid droplets of inks (JIS Z8123-1: 2013), and hereinafter, this permanent head will be referred to as an "ink jet head". This ink jet printer has been used as an image recording apparatus, and besides, it has been applied to various manufacturing apparatuses in the form in which its characteristic of enabling each liquid droplet of a very small volume to be landed at a corresponding predetermined position with accuracy is exploited.

Such an ink jet printer is configured such that, for example, an ink storage member is attached to an ink jet head so as to be replaceable, and an ink stored in the ink storage member is flown into a flow path provided in the ink jet head. In addition, the ink storage member is also called, for example, an ink cartridge or an ink tank. There are various types for such an ink storage member, and among them, there is a foam type ink storage member that contains therein an absorber for absorbing and retaining an ink (refer to, for example, JP-A-2000-127431). In addition, the absorber is also called a porous material or foam.

In such a foam type ink storage member, a gradient arises in a concentration distribution of solid ingredients (including a pigment, a dispersing agent, and a resin material) of an ink retained in the absorber (in other words, concentration unevenness arises in the ink retained in the absorber) due to a difference between a specific gravity of the solid ingredients and a specific gravity of a solvent therefor, thereby also causing a gradient to arise in a viscosity distribution of the ink. More specifically, there is a tendency in that, in the absorber contained in an ink storage member being placed in a still state, the lower a position in a gravity direction becomes, the higher a concentration and a viscosity of the ink become; while the higher a position in a gravity direction becomes, the lower a concentration and a viscosity of the ink become. In the case of an ink storage member of a type in which the absorber is not used, it is possible to uniformize the concentration of the ink retained in the ink storage member to a certain degree by allowing a user to agitate the ink by means of, for example, shaking of the ink storage member, but in the case of an ink storage member of a foam type, it is difficult to eliminate variations in the concentration and the viscosity of the ink merely by means of the shaking of the ink storage member.

In general, the ink storage members are distributed in markets in a posture in which a connector portion thereof to be connected to an ink jet head (that is, a connection portion thereof from which the ink contained therein is flown out toward the ink jet head) is located at an approximately lower position in a vertical direction. Thus, a viscosity of an ink initially flown out from an ink storage member having been newly attached to the ink jet printer tends to be high. Thereafter, with consumption of an ink inside the ink storage member by ejection operations of the ink jet head, the concentration of the ink is gradually made uniform. The ink initially flown out from the newly attached ink storage member, however, has a larger flow-path resistance, compared with a desired ink (that is, an ink in a state in which its concentration and viscosity has been made stable to a certain degree after a certain period of consumption of the ink). Thus, when the ink initially flown out from the newly attached ink storage member is ejected under the same condition as that for the desired ink, as a result, a lack of an amount of an ink to be fed to a nozzle arises, thereby sometimes causing a phenomenon in which a meniscus is not correctly formed inside the nozzle. Further, this phenomenon is likely to cause a discharge failure, that is, a failure in that any ink is not ejected through the nozzle, or a failure in that, even though an ink is ejected through the nozzle, a direction of the ejected ink is deflected from a predetermined target direction.

SUMMARY

An advantage of some aspects of the invention is that an ink jet printer and a control method therefor are provided, which enable suppression of the occurrence of a discharge failure in initial discharge of an ink contained in a newly attached ink storage member.

An ink jet printer according to a first aspect of the invention includes an attachment detection portion that detects an attachment of an ink storage member that retains an ink in an absorber contained in the ink storage member itself; an ink jet recording head that ejects an ink flown in from the ink storage member; and a control circuit that controls ink ejection performed by the ink jet recording head. The control circuit is configured to, upon detection, by the attachment detection portion, of an attachment of the ink storage member to be newly used, perform control so as to cause a first operation mode to be set, and thereafter, perform control so as to cause the first operation mode to be switched to a second operation mode, upon satisfaction of a condition in that a total discharge amount of an ink ejected in the first operation mode reaches a prescribed amount. Further, a per-unit-time discharge amount of an ink ejected in the first operation mode is set so as to be smaller than a per-unit-time discharge amount of an ink ejected in the second operation mode.

Further, a control method for an ink jet printer, according to a second aspect of the invention, is a control method for an ink jet printer provided with an ink jet recording head, to which an ink storage member that retains an ink in an absorber contained in the ink storage member itself is attached, and which ejects an ink flown in from the ink storage member, and the control method includes a first process of detecting an attachment of the ink storage member to be newly used; a second process of setting a first operation mode; a third process of detecting a satisfaction of a condition in that a total discharge amount of an ink ejected in the first operation mode reaches a prescribed amount; and a fourth process of switching the first operation mode to a second operation mode upon detection of the satisfaction of the condition in the third process. Further, a per-unit-time discharge amount of an ink ejected in the first operation mode is set so as to be smaller than a per-unit-time discharge amount of an ink ejected in the second operation mode.

According to the above aspects of the invention, in an initial stage immediately after an ink storage member has been newly attached, a per-unit-time amount of an ejected ink is suppressed to a relatively small amount, and thus, even when an ink which is contained in the newly attached ink storage member and which has a relatively high viscosity is ejected, a reduction of a degree of a lack of an amount of an ink to be fed to a corresponding nozzle can be achieved, thereby enabling the occurrence of an ink discharge failure to be suppressed. As a result, it becomes possible to prevent the degradation of an image quality of an image or the like printed on a recording medium, such as printing paper.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is practiced will be described with reference to the accompanying drawings. It is to be noted that an embodiment described below is a preferred specific example of the invention and thus includes various limitations, but the scope of the invention is not limited to such an embodiment described below except for a particular portion in the following description, in which a limitation of the invention is stated. Further, in the following, an ink jet image recording apparatus will be described as an example of the above ink jet printer according to the first aspect of the invention. In addition, hereinafter, this ink jet image recording apparatus will be referred to as just a printer.

Figure 1:
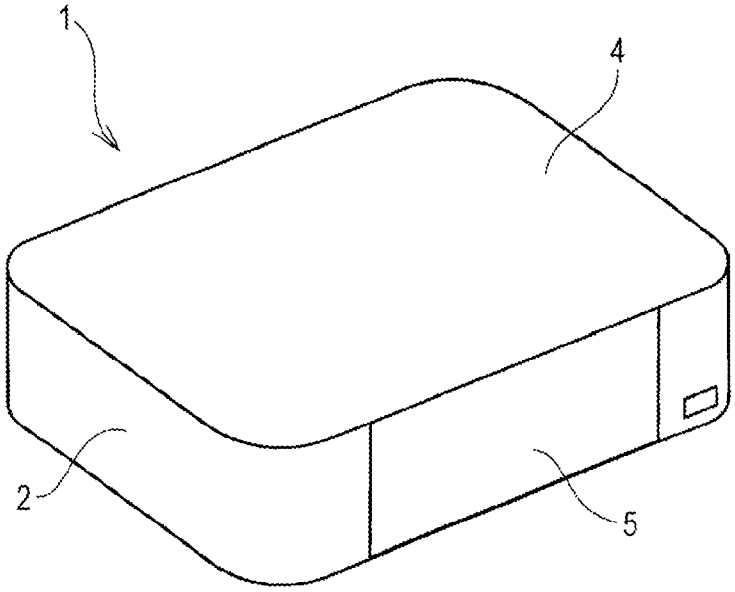
FIG. 1 is a perspective view that describes a configuration of an external view of a printer according to an embodiment of the invention.
Figure 2:
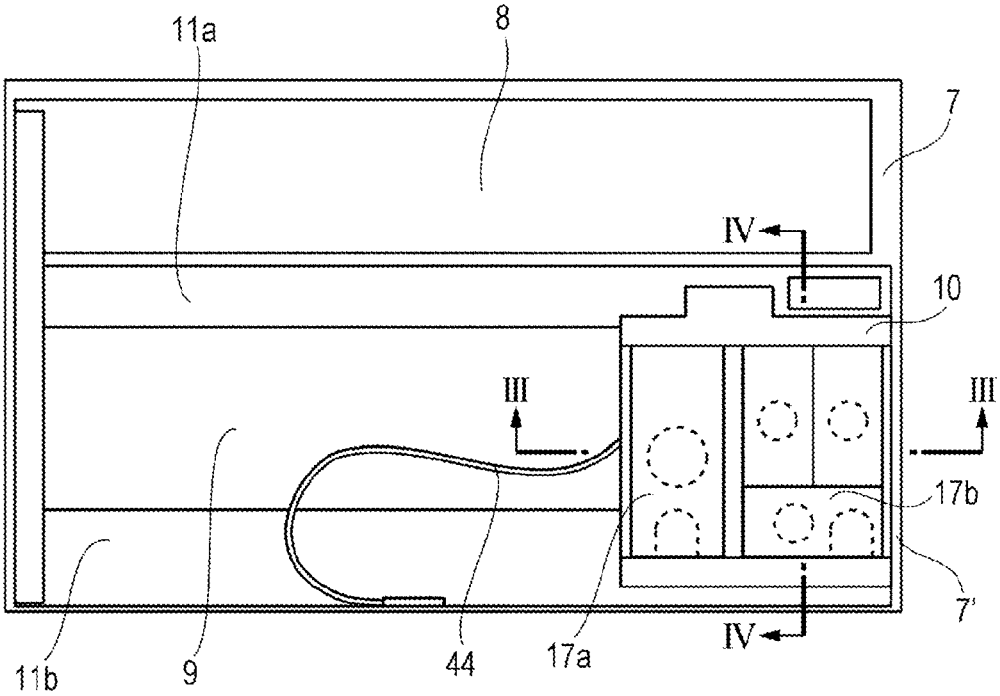
FIG. 2 is a plan view that describes an internal configuration of a printer according to an embodiment of the invention.
Figure 3:
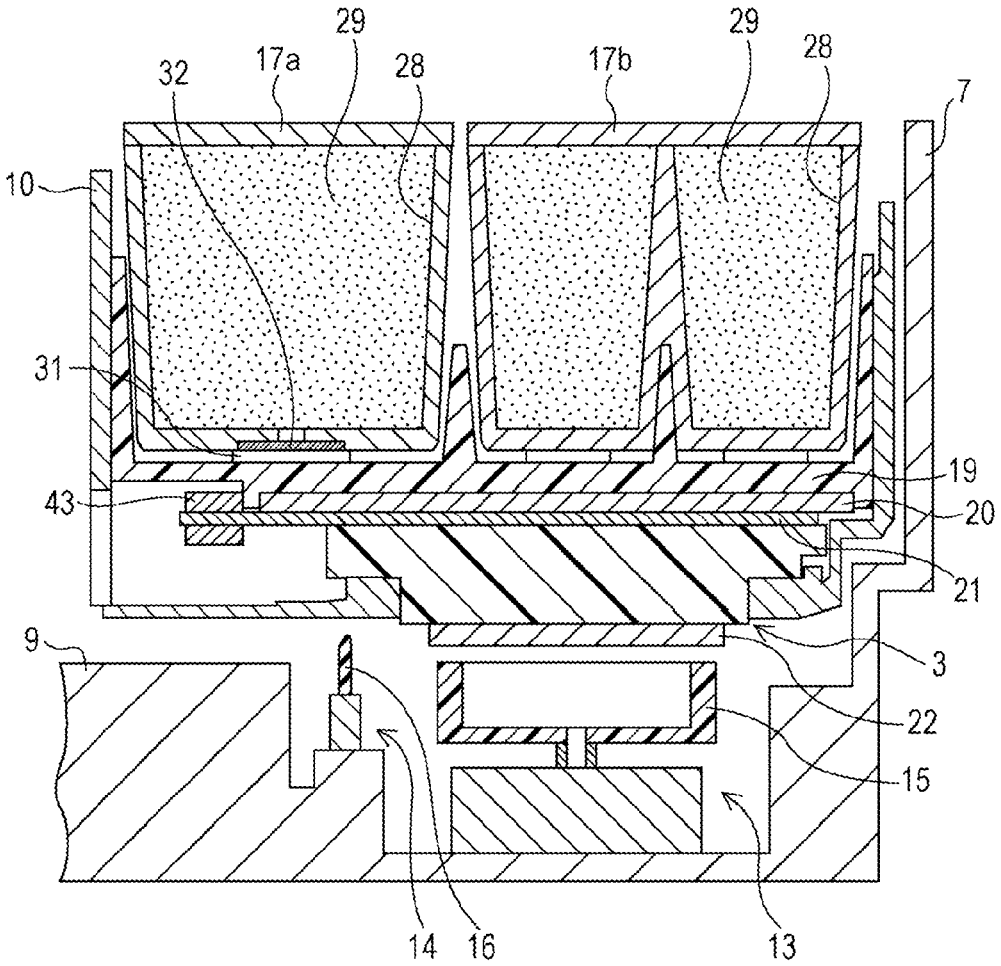
FIG. 3 is a cross-sectional view taken along the line III-III of FIG. 2.
Figure 4:
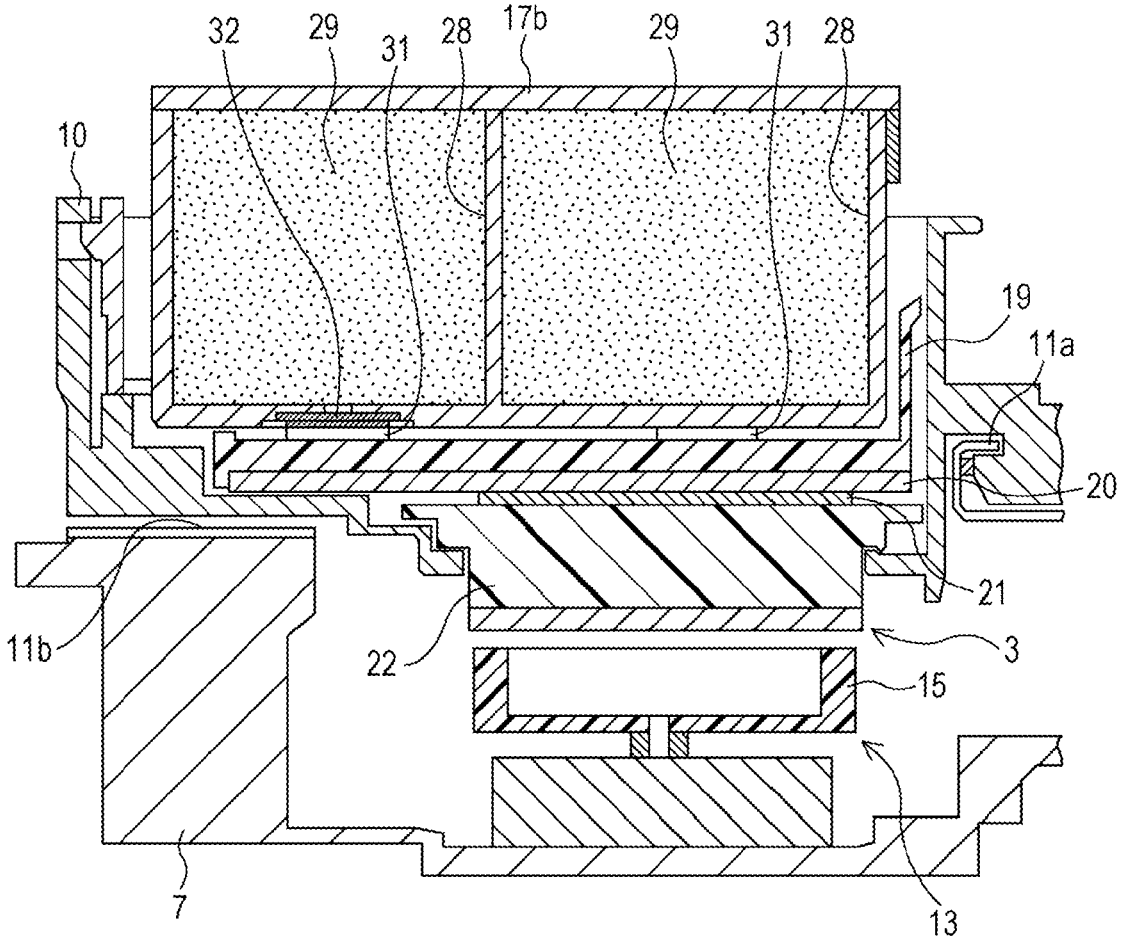
FIG. 4 is a cross-sectional view taken along the line IV-IV of FIG. 2.

FIG. 1 is a perspective view that describes a configuration of an external view of a printer 1, and FIG. 2 is a plan view that describes an internal configuration of the printer 1. Further, FIG. 3 is a cross-sectional view taken along the line III-III of FIG. 2, and FIG. 4 is a cross-sectional view taken along the line IV-IV of FIG. 2. The printer 1 in this embodiment includes a carriage 10 inside a housing 2 of a printer body of the printer 1, as well as an ink jet recording head 3 which belongs to a kind of ink jet head and which is mounted in the carriage 10. In addition, hereinafter, this ink jet recording head 3 will be referred to as just a recording head 3. Further, the printer 1 is configured to perform printing of photo images, texts, and the like on recording paper, a postcard, or the like (i.e., a recording medium or a liquid droplet landing target) by ejecting inks (belonging to a kind of liquid) through nozzles 63 of the recording head 3. A body cover 4 is provided at an upper face side of the housing 2, and a front cover 5 is provided at a front face side of the housing 2. These body cover 4 and front cover 5 are joined to each other so as to form a unified structure, and the printer 1 is configured to enable a user to open an upper face of the housing 2 by allowing the user to lift up an edge portion of a front face side of the unified structure and rotate the lifted-up unified structure about a rotation axis, which is an edge portion of a rear face side of the unified structure, up to a rear face side of the housing 2. These body cover 4 and front cover 5 in the opened state function as a paper feeding tray on which recording paper or the like is set. Further, these body cover 4 and front cover 5 in the opened state enable a user to perform replacement of one or more of ink cartridges 17.

The inside of the housing 2 is partitioned by a body frame 7 made of a metallic material into two portions: one being a paper feeding portion 8*a* in which a feeding mechanism (not illustrated) for feeding the sheets of recording paper to a platen 9 side; the other one being a printing portion 8*b* in which printing (recording operation) is performed by the recording head 3 on recording paper or the like having been fed on the platen 9. A guide frame 11*a* and a guide frame 11*b* are provided on the body frame 7 at the rear face side of the printing portion 8*b* and on the body frame 7 at the front face side of the printing portion 8*b*, respectively, so as to be parallel to each other along a long-side of the housing 2. The carriage 10 is configured such that its front and rear sides are supported by the guide frames 11*a* and 11*b*. The carriage 10 is configured so as to be reciprocatable by being guided along these guide frames 11*a* and 11*b* by a driving force applied by a driving motor of a carriage moving mechanism 85 (refer to FIG. 6) described below.

A home position, which is a waiting position of the recording head 3 as well as a base point of scanning operation thereof, is provided at one edge side (at a right-hand side of FIG. 2) of a movement range of the carriage 10. In a portion corresponding to this home position, there are provided a capping mechanism 13 (a capping means) and a wiping mechanism 14 (a wiping means) in order from the one edge side of the movement range of the carriage 10. The capping mechanism 13 includes a cap 15 which is formed of an elastic member made of, for example, an elastomeric material, and the capping mechanism 13 is configured to be capable of transforming the cap 15 into any one of two states: one being a capping state in which a head cover 26 (not illustrated), which is provided so as to enclose a circumference of a nozzle face of the recording head 3, is sealed by the cap 15 having been brought into contact with the head cover 26; the other one being a shunted state in which the cap 15 is distanced from the head cover 26. The capping mechanism 13 is configured to, in the capping state, be capable of making pressure inside the cap 15 negative by using a pomp (not illustrated) and thereby be capable of performing cleaning operation for evacuating inks and air bubbles from the nozzles 63 of the recording head 3. Further, the cap 15 also functions as an ink receptor for receiving ejected ink droplets during flushing processing.

The wiping mechanism 14 is a mechanism for wiping the nozzle face of the recording head 3 by using a wiper 16, and is configured to be capable of transforming the wiper 16 into any one of two states: one being a state in which the wiper 16 is in contact with the nozzle face; the other one being a shunted state in which the wiper 16 is distanced from the nozzle face. The wiper 16 can be realized by employing any one of various types of wipers, such as a wiper resulting from forming a water-repellent film on a surface of a blade body made of a resign material or the like, and a cloth wiper whose contact portion contacted with the nozzle face is made of cloth. In this embodiment, the carriage 10 moves in a main-scanning direction in a state in which the wiper 16 is in contact with the nozzle face of the recording head 3, thereby causing the wiper 16 to wipe the nozzle face while siding one the nozzle face. In addition, it is also possible to employ a configuration which allows the wiper 16 to, in a state in which the recording head 3 halts its movement, to run by itself and thereby wipe the nozzle face. In brief, it is sufficient for the recording head 13 and the wiper 16 merely to be configured such that they make relative movement and thereby the nozzle face is wiped.

The recording head 13 in this embodiment includes a holder 19, a flow path plate 20, a circuit substrate 21, and a head unit 22. Further, the head unit 22 includes, for each of component groups constituting the head unit 22, an oscillator unit 23, a head case 24, a flow path unit 25, and the like.

The holder 19 is a member made of, for example, a synthetic resin material, and is a portion in which the ink cartridges 17, which belong to a kind of ink storage member, are attached. In this embodiment, a black ink cartridge 17*a* and a color ink cartridge 17*b* can be attached in the holder 19. Each of these ink cartridges 17 includes at least one ink storage chamber 28 partitioned therein, as well as an absorber 29 formed of a porous material, such as polyurethane foam, in each of the at least one ink storage chamber 28, and causes the absorber 29 to absorb and retain an ink. At least one ink flow-out portion 32 is provided on a lower face of each of the ink cartridges 17 (i.e., on a face constituting each of the ink cartridges 17, and facing a cartridge attachment side face of the holder 19), and through each of the at least one ink flow-out portion 32, an ink inside a corresponding ink storage chamber 28 is flown out. Further, a contact ROM 30 (refer to FIG. 6) is provided in each of the ink cartridges 17. This contact ROM 30 is constituted by, for example, an EEPROM belonging to a kind of semiconductor storage means. In this contact ROM 30, various pieces of information in relation to a corresponding one of the ink cartridges 17 are recorded. Such various pieces of information include, for example, a type code indicating a type of the printer 1, a date code indicating a manufactured date or the like, and pieces of ink information. The pieces of ink information include, for example, an initial amount of the ink; a remaining amount of the ink; a material code indicating a color material, such as a colorant or a pigment, and a color of the ink; a piece of information indicating a concentration of the color material; and a piece of information indicating a viscosity of the ink.

An ink flow-in portion 31 is provided at a portion which is located on an upper face of the holder 19 and above which a corresponding ink cartridge 17 is attached. This ink flow-in portion 31 is a portion connected to the ink flow-out portion 32 of the corresponding ink cartridge 17, and the ink flow-in portion 31 is provided for each of color inks. In this embodiment, the ink flow-in portion 31 is provided at each of four positions, which is associated with a corresponding one of four color inks, that is, a black ink, a cyan ink, a magenta ink, and a yellow ink. This ink flow-in portion 31 includes a filter and a porous member (an absorbing member), which are not illustrated, inside an opening of a cylindrical portion of the ink flow-in portion 31 itself. Further, a porous member is also provided inside each of the at least one ink flow-out portion 32 of each of the ink cartridges 17, and when one of the ink flow-out portions 32 is connected to a corresponding one of the ink flow-in portions 31, the two porous members thereof come into contact with each other, so that a capillary attraction causes an ink contained in a corresponding ink storage chamber 28 to be flown out through the ink flow-out portion 32 and causes the flown-out ink to be flown in through the ink flow-in portion 31. When an ink is flown in through the ink flow-in portion 31, the ink is filtered by the filter and then, a resultant ink is guided toward a head unit 22 side through an intermediate flow path (not illustrated) provided in the flow path plate 20. Further, a contact terminal 33, which is to be electrically connected to the contact ROM 30 of a corresponding ink cartridge 17, is provided on a portion which is located on the upper face of the holder 19 and on which the corresponding ink cartridge 17 is attached (refer to FIG. 6).

The circuit substrate 21 is disposed between the flow path plate 20 and the head unit 22. This circuit substrate 21 is a substrate for relaying driving signals, other control signals and the like which are transmitted from a printer body side to piezoelectric elements 48. This circuit substrate 21 is a substrate on which a terminal portion (not illustrated) electrically connected to a terminal portion of a flexible cable 50 described below is formed, and further, a connector 43 for use in connection to the printer body side, other electronic components, and the like, are mounted. The connector 43 is connected to a flexible flat cable (FFC) 44 (refer to FIG. 2), and the circuit substrate 21 is configured to receive the driving signals and the like from the printer body side via this FFC 44.

Figure 5:
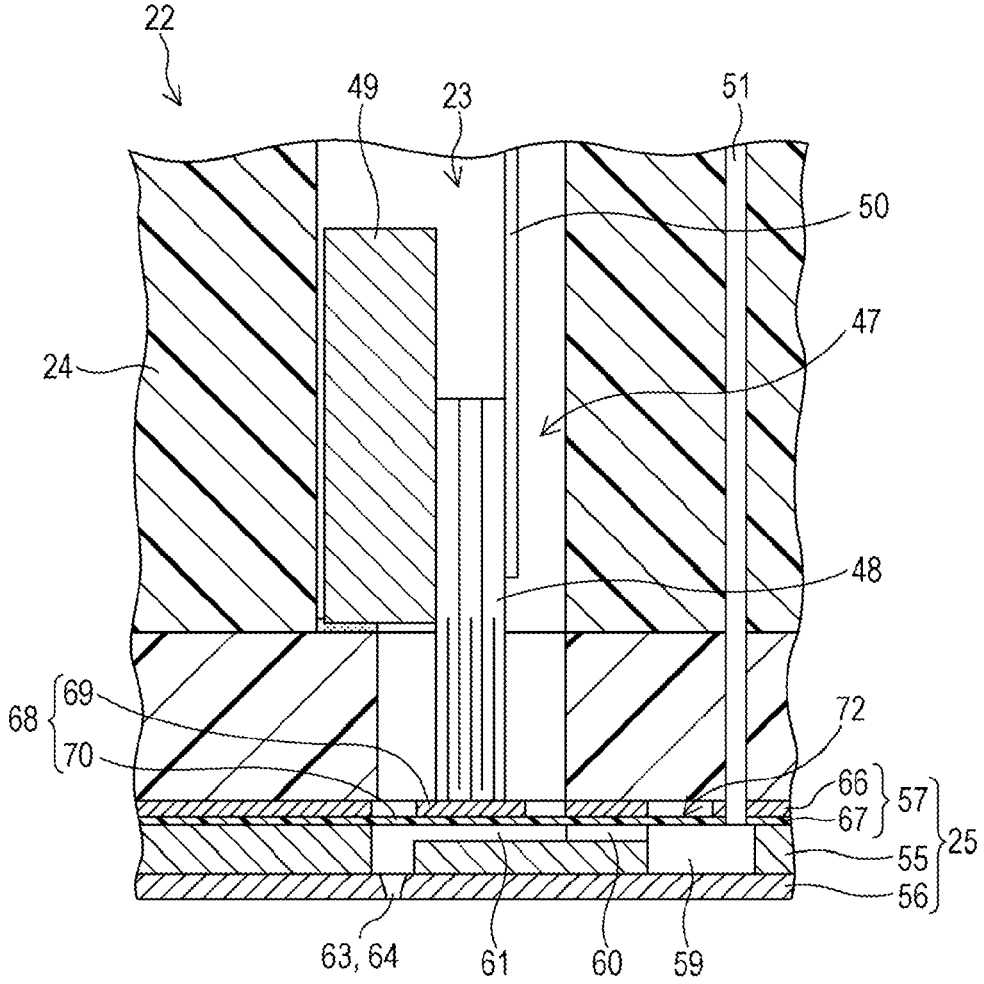
FIG. 5 is a main-portion cross-sectional view that describes a head unit according to an embodiment of the invention.

FIG. 5 is a main-portion cross-sectional view that describes the head unit 22. The head case 24 is a member which is mainly made of a synthetic resin material, such as an epoxy resin material. A rigidity of a portion which constitutes the head case 24 and to which the flow path unit 25 is joined is increased through a method of manufacturing it by using a metallic material, such as a stainless steel material. Further, in the inside of the head case 24, a storage space portion 47 for containing the oscillator unit 23 therein is formed in the state of penetrating in a height direction. In the head case 24, a case flow path 51 is formed in the state of penetrating in a height direction at a position deviated outward from the storage space portion 47 in a carriage scanning direction. An upstream-side edge of the case flow path 51 opens on an upper face of the head case 24, and communicates with the intermediate flow path of the flow path plate 20. Further, a downstream-side edge of the case flow path 51 opens on a lower face of the head case 24, and communicates with a common liquid chamber 59 of the flow path unit 25. Moreover, in the head case 24, an open air communication path 52 (not illustrated) is formed at a position deviated outward from the case flow path 51 in a nozzle row direction. This open air communication path 52 is a path which is a portion constituting an open air communication path, and one of edges of the open air communication path 52 opens on the upper face of the head case 24, and communicates with an open air groove 40 (not illustrated) of the flow path plate 20 via a penetration hole. Further, the other one of the edges (i.e., a downstream-side edge) of the open air communication path 52 opens on the lower face of the head case 24, and communicates with a space of a compliant portion 72.

The oscillator unit 23 includes the piezoelectric element 48 functioning as an element belonging to a kind of actuator; a fixed plate 49 to which the piezoelectric elements 48 is joined; and a flexible cable 50 for supplying driving signals and the like to the piezoelectric element 48. The piezoelectric element 48 is a lamination type piezoelectric element which is manufactured by carving, in a comb teeth-like shape, a piezoelectric plate resulting from alternately stacking piezoelectric substance layers and electrode layers. Further, the piezoelectric element 48 is an electric-field transverse effect type piezoelectric element in a vertical oscillation mode, which is expandable and contractible in a direction orthogonal to a lamination direction (an electric field direction).

The flow path unit 25 is constituted by a nozzle substrate 56, which is joined to one of faces of the flow path substrate 55, and an oscillation plate 57, which is joined to the other one of the faces of the flow path substrate 55. That is, the flow path substrate 55, the nozzle substrate 56, and the oscillation plate 57 are flow-path unit constituent members (constituent components). This flow path unit 25 includes the common liquid chamber 59 (a reservoir), an ink feed opening 60, a pressure chamber 61, a nozzle communication opening 62, and the nozzle 63. Further, a series of ink flow paths from the ink feed opening 60 up to the nozzle 63 via the pressure chamber 61 and the nozzle communication opening 62 are formed so as to correspond to each of the nozzles 63. Further, each of the flow-path-unit constituent members is constituted by a plate material having a long side extending in a nozzle row direction.

The nozzle substrate 56, a member disposed at the lowest layer among the flow-path-unit constituent members, is a plate member in which holes each associated with a corresponding one of the plurality of nozzles 63 are provided at intervals of a pitch corresponding to a dot formation density (for example, 180 dpi). A metallic plate made of a stainless steel material, a silicon single crystal substrate or the like can be employed as a material of the nozzle substrate 56. In the nozzle substrate 56, two nozzle rows 64 (nozzle groups) each resulting from lining up a plurality of the nozzles 63 are provided, and each of the nozzle rows 64 is composed of the nozzles 63 whose total number is, for example, one hundred and eighty. A lower face of the nozzle substrate 56 (i.e., a face which constitutes the nozzle substrate 56 and from which inks fed through the nozzles 63 are ejected) is the nozzle face. In addition, the number of the nozzle rows 64 to be formed in the nozzle substrate 56 and the number and pitch of the nozzles 63 constituting each of the nozzle rows 64 are not limited to those having been exemplified in this embodiment, but can be optionally and appropriately configured.

The oscillation plate 57, which is the highest layer material among the flow-path-unit constituent materials, has a double structure in which an elastic film 67 is stacked on a surface of a supporting plate 66. In this embodiment, a metallic plate made of a stainless steel material or the like is employed as the supporting plate 66, and the oscillation plate 57 is constituted by a composite plate material resulting from laminating a resin film as the elastic film 67 on the surface of the supporting plate 66. There is provided a diaphragm 68 which varies the volume of the pressure chamber 61 on the oscillation plate 57. This diaphragm 68 is manufactured by partially eliminating the supporting plate 66 by means of etching or the like. That is, this diaphragm 68 is constituted by an island portion 69, to which an apical surface of a free edge portion of the piezoelectric element 48 is joined, and a flexible portion 70, which is provided around the periphery of the island portion 69. The apical surface of the free edge portion of the piezoelectric element 48 is joined to the island portion 69. Further, a variation of a volume of the pressure chamber 61 can be caused by displacing the diaphragm 68 through a method of elongating and contracting the free edge portion of the piezoelectric element 48.

Further, the compliant portion 72 for sealing the common liquid chamber 59 is provided in a portion which constitutes the oscillation plate 57 and which faces the common liquid chamber 59 included in the flow path substrate 55. The compliant portion 72 is manufactured by eliminating a portion which constitutes the supporting plate 66 and which is included in an area facing an aperture plane of the common liquid chamber 59 by means of etching or the like so that only the elastic film 67 exists in the above area. Further, the compliant portion 72 functions as a damper for absorbing variations of pressure of a liquid stored in the common liquid chamber 59. In addition, in the oscillation plate 57, the supporting plate 66 is joined to the flow path substrate 55, and the elastic film 67 is joined to the head case 24.

The flow path substrate 55 in this embodiment is a plate-shaped member in which space portions resulting from partitioning an ink flow path, that is, specifically, a space portion corresponding to the common liquid chamber 59, a space portion corresponding to the ink feed opening 60, and a space portion corresponding to the pressure chamber 61. In addition, hereinafter, these space portions will be referred to as just the common liquid chamber 59, the ink feed opening 60, and the common liquid chamber 61. The flow path substrate 55 is manufactured by performing anisotropic etching of, for example, a silicon wafer which belongs to a kind of crystalline base material.

Figure 6:
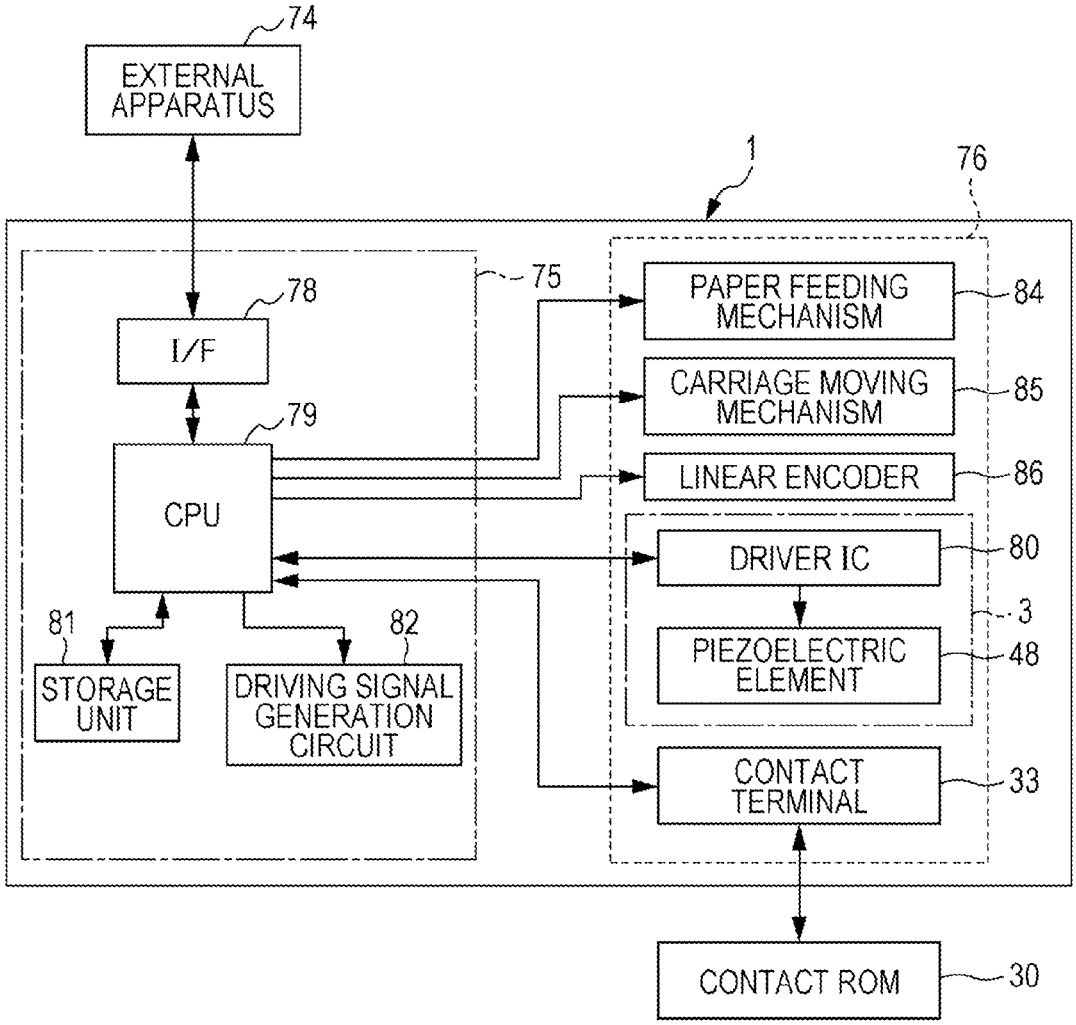
FIG. 6 is a block diagram that describes an electric configuration of a printer according to an embodiment of the invention.

FIG. 6 is a block diagram that describes an electric configuration of the printer 1.

The printer 1 in this embodiment is communicably connected to an external apparatus 74, which is, for example, an electronic device, such as a computer, via a wireless link or a wired link. Further, the printer 1 receives print data corresponding to images and/or texts from the external apparatus 74 in order to perform printing of the images and/or the texts on recording paper or the like. The printer 1 includes a printer controller 75 and a printing engine 76. Further, the printer 1 includes the contact terminals 33 each electrically connected to the contact ROM 30 included in a corresponding one of the ink cartridges 17.

The printer controller 75 is a control unit for controlling individual portions of the printer 1. The printer controller 75 in this embodiment includes an interface (I/F) 78, a central processing unit (CPU) 79, a storage unit 81, and a driving signal generation circuit 82. The interface 78 receives a set of print data and a print instruction having been transmitted from the external apparatus 74, and transmits a set of state information related to the printer 1 to the external apparatus 74. The CPU 79 is an arithmetic processing device for controlling the entire printer 1, and belongs to a kind of the above control circuit in the first aspect of the invention. The storage unit 81 is a unit for storing therein data for use in programs executed by the CPU 79 and various kinds of control performed by the CPU 79, and the storage unit includes ROM modules, RAM modules, and NVRAM modules (non-volatile RAM modules). The CPU 79 controls individual units in accordance with the programs stored in the storage unit 81. Further, the CPU 79 in this embodiment generates a set of ejection data indicating which of inks is to be ejected through which of the nozzles 63 at which of timing points, on the basis of the print data from the external apparatus 74, and transmits the set of ejection data to a driver IC 80 included in the recording head 3. The driver IC 80 performs selective supply control of driving signals to be supplied to the piezoelectric elements 48 on the basis of the set of ejection data. Moreover, the CPU 79 in this embodiment causes the recording head 3 to perform flushing processing which belongs to a kind of maintenance processing. The driving signal generation circuit 82 generates driving pulses which cause inks to be ejected onto recording paper or the like through the nozzles 63 of the recording head 3 so that images or the like are printed thereon.

Next, the printing engine 76 will be described. The printing engine 76 in this embodiment includes a paper feeding mechanism 84, the carriage moving mechanism 85, a linear encoder 86, the recording head 3, the contact terminals 33, and the like. The carriage moving mechanism 85 includes the above carriage 10, a driving motor (not illustrated), such as a DC motor, for driving the carriage 10 to move along the guide frames 11*a* and 11*b*, and the like, and causes the recording head 3 mounted in the carriage 10 to reciprocate in the main-scanning direction. The paper feeing mechanism 84 includes a paper feeding motor (not illustrated), a paper feeding roller (not illustrated) and the like, and sequentially feeds recording paper or the like onto the platen 9 from the paper feeding portion 8*a* in conjunction with the reciprocation of the recording head 3 in the main-scanning direction. Further, the linear encoder 86 outputs encoder pulses in accordance with a scanning position of the recording head 3 mounted in the carriage 10 to the printer controller 75, which handles the encoder pulses as a piece of position information indicating a position of the recording head 3 in the main-scanning direction. The CPU 79 of the printer controller 75 can identify a scanning position (a current position) of the recording head 3 on the basis of the encoder pulses having been received from the linear encoder 86.

Each of the above contact terminals 33 is configured to be electrically connectable to the contact ROM 30 of a corresponding one of the ink cartridges 17 in the state of being attached in the holder 19 of the recording head 3. Further, the contact terminals 33 are electrically connected to the CPU 79 of the printer controller 75, and thus, when any one of the ink cartridges 17 has been attached into the recording head 3, the CPU 79 can retrieve various pieces of information recorded in the contact ROM 30 of the relevant ink cartridge 17. Further, the CPU 79 can detect an attachment/detachment of each of the ink cartridges 17 to/from the recording head 3 on the basis of a state of a connection between the contact ROM 30 included in the each of the ink cartridges 17 and a corresponding one of the contact terminals 33. Further, the CPU 79 can rewrite the various pieces of information recorded in the contact ROM 30 of any one of the ink cartridges 17 which is in the state of being attached in the recording head 3. The contact ROM 30 and the contact terminal 33 in this embodiment function as the above attachment detection portion in the first aspect of the invention.

Here, as described above, the ink cartridge 17 handled in the printer 1 in this embodiment is a so-called foam type ink cartridge which causes the absorber 29 to retain an ink. Thus, a viscosity of an ink initially flown into the recording head 3 from such an ink cartridge 17 having been newly attached into the printer 1 tends to be higher than a viscosity supposed in specification for the printer 1 (for example, a viscosity recorded in the contact ROM). When printing processing is performed as usual without considering this trend, the feed of such an ink to corresponding ones of the nozzles 63 does not catch up the printing processing due to influence of such a relatively high viscosity, whereby a discharge failure is likely to arise. In the printer 1 according to this embodiment of the invention, therefore, when any one of the ink cartridges 17 has been newly attached, processing for dealing with a viscosity higher than a viscosity supposed in specification for the printer 1 is carried out. Hereinafter, this processing will be described.

Figure 7:
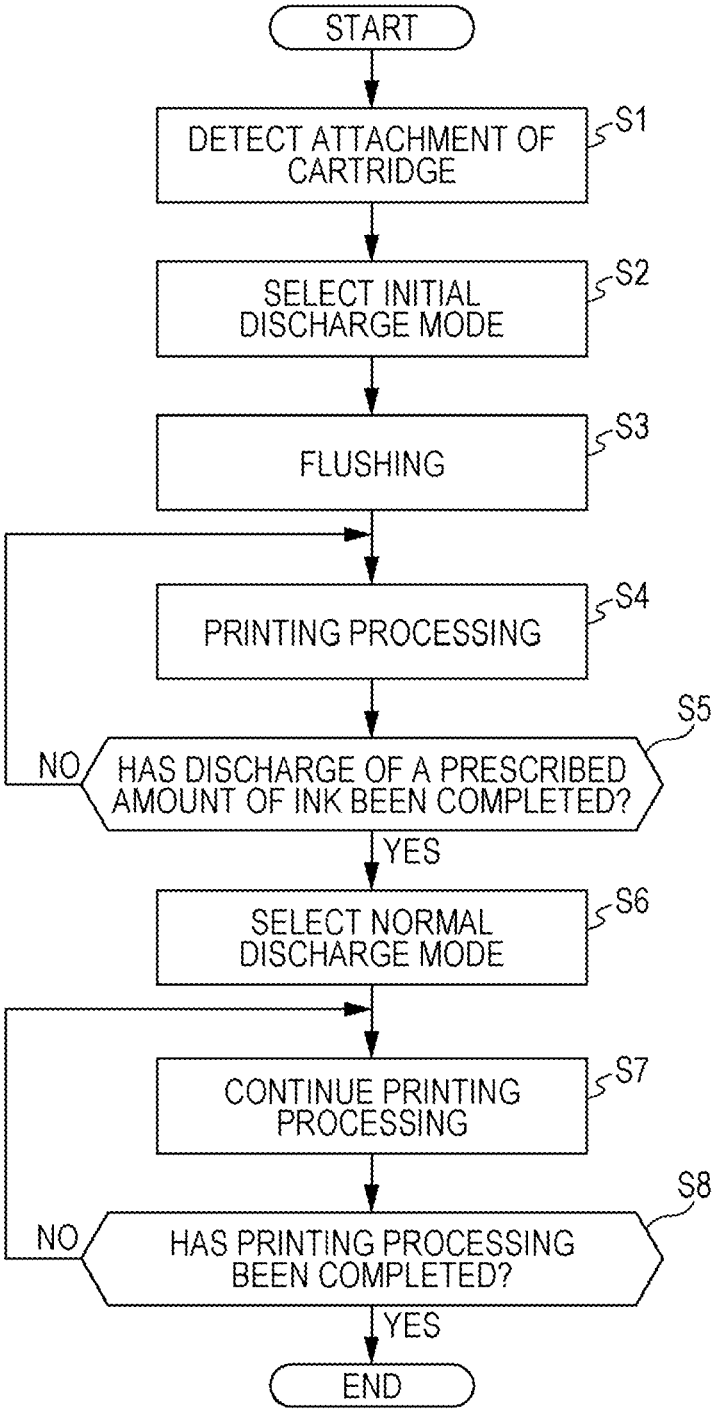
FIG. 7 is a flowchart that describes operation of a printer according to an embodiment of the invention.

FIG. 7 is a flowchart that describes operation of the printer 1.

As described above, the printer 1 in this embodiment detects an attachment of a new ink cartridge 17 on the basis of a state of a connection between a corresponding contact terminal 33 and the contact ROM 30 of the relevant ink cartridge 17 (step S1, which corresponds to the above first process in the second aspect of the invention). Upon detection of the attachment of the new ink cartridge 17, the CPU 79 selects an initial discharge mode (which corresponds to the above first operation mode in each of the first and second aspects of the invention) from among selectable discharge modes in the printer 1 (step S2, which corresponds to the above second process in the second aspect of the invention). With respect to the discharge modes, two modes are selectable in accordance with a difference therebetween in a per-unit-time discharge amount: a first one of the modes being the initial discharge mode; a second one of the modes being a normal discharge mode (which corresponds to the above second operation mode in each of the first and second aspects of the invention). The normal discharge mode is a mode corresponding to discharge of an ink which is contained in the cartridge 17 and which is in a state in which a viscosity of the ink is stable, that is, a state in which a gradient of viscosity of the ink and a gradient of concentration of the ink have been eliminated and the viscosity of the ink has reached a viscosity supposed in specification for the printer 1 (or a viscosity approximately equal thereto). In contrast, the initial discharge mode is a mode corresponding to discharge of an ink whose viscosity is higher than a viscosity supposed in specification for the printer 1.

Figure 8A:
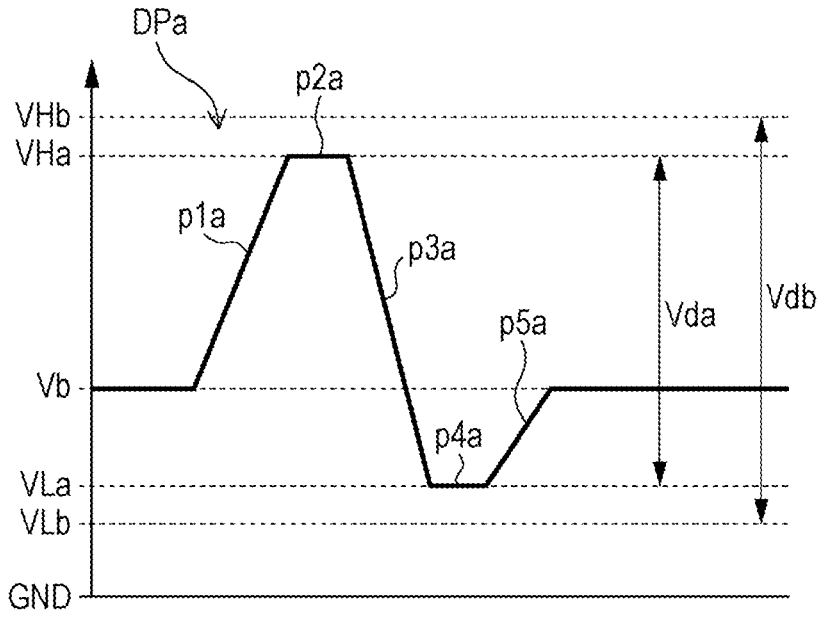
FIGS. 8A and 8B are waveform diagrams that describe configurations of two kinds of driving pulses according to an embodiment of the invention.
Figure 8B:
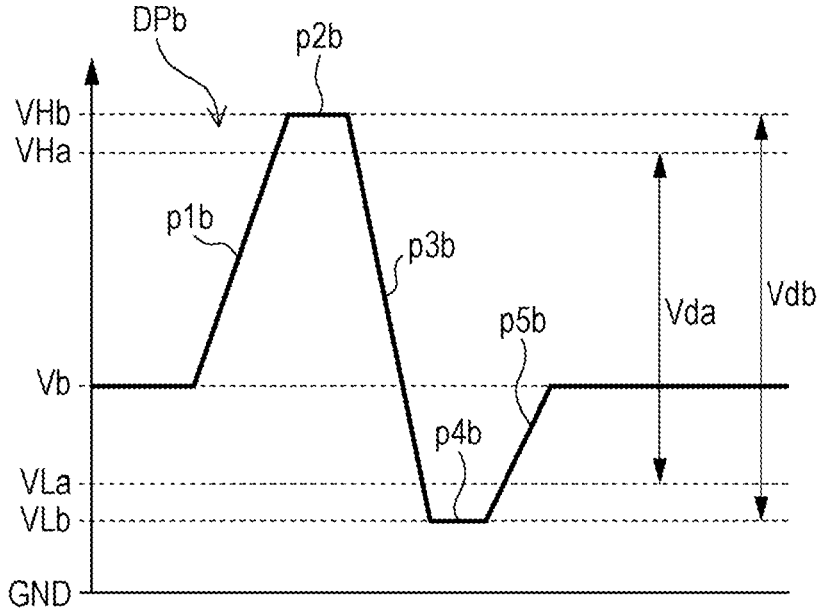

FIGS. 8A and 8B are waveform diagrams that describe configurations of driving pulses for driving the piezoelectric element 48 to discharge an ink through the nozzle 63. Further, FIG. 8A illustrates a first driving pulse DPa for use in the initial discharge mode, and FIG. 8B illustrates a second driving pulse DPb for use in the normal discharge mode. In this embodiment, the first driving pulse DPa is a driving pulse which is used in common in printing processing for performing printing of images or the like on recording paper or the like and flushing processing described below.

The first driving pulse DPa is composed of a first preliminary expansion element p1*a* whose electric potential rises at a constant gradient from a reference electric potential Vb to a first expansion electric potential VHa; a first expansion holding element p2*a* which holds the first expansion electric potential VHa, which is a posterior-edge electric potential of the first preliminary expansion element p1*a*, during a constant time; a first contraction element p3*a* whose electric potential falls at a relatively steep gradient from the first expansion electric potential VHa to a first contraction electric potential VLa; a first contraction holding element p4*a* which holds the first contraction electric potential VLa during a constant time; and a first returning expansion element p5*a* whose electric potential returns at a constant gradient from the first contraction electric potential VLa to the reference electric potential Vb.

When the above first driving pulse DPa is supplied to the piezoelectric element 48, first, the piezoelectric element 48 contacts in accordance with a variation of an electric potential of the first preliminary expansion element p1*a*, and with the contraction of the piezoelectric element 48, the pressure chamber 61 expands from a reference volume thereof corresponding to the reference electric potential Vb to an expanded volume thereof which corresponds to the first expansion electric potential VHa and which is a maximum volume thereof. Through this operation, a meniscus inside the nozzle 63 is pulled toward the pressure chamber 61. The expanded state of the pressure chamber 61 is constantly held during a period when the first expansion holding element p2*a* is supplied. Subsequently to the supply of the first expansion holding element p2*a*, when the piezoelectric element 48 is supplied with the first contraction element p3*a*, the piezo electric potential element 48 extends, and with this extension of the piezo electric potential element 48, the pressure chamber 61 rapidly contracts from the above maximum volume thereof to a contracted volume thereof corresponding to the first contraction electric potential VLa. This rapid contraction of the pressure chamber 61 pressurizes the ink inside the pressure chamber 61, thereby causing ink droplets to be discharged through the nozzle 63. This contracted state of the pressure chamber 61 is kept during a period when the first contraction holding element p4*a* is supplied, and subsequently, when the piezoelectric element 48 is supplied with the first returning expansion element p5*a*, the pressure chamber 61 returns from a volume thereof corresponding to the first contraction electric potential VLa to the reference volume thereof corresponding to the reference electric potential Vb.

The second driving pulse DPb is composed of a second preliminary expansion element p1*b* whose electric potential rises at a constant gradient from the reference electric potential Vb to a second expansion electric potential VHb; a second expansion holding element p2*b* which holds the second expansion electric potential VHb, which is a posterior-edge electric potential of the second preliminary expansion element p1*b*, during a constant time; a second contraction element p3*b* whose electric potential falls at a relatively steep gradient from the second expansion electric potential VHb to a second contraction electric potential VLb; a second contraction holding element p4*b* which holds the second contraction electric potential VLb during a constant time; and a second returning expansion element p5*b* whose electric potential returns at a constant gradient from the second contraction electric potential VLb to the reference electric potential Vb. This second driving pulse DPb has a higher driving voltage than that of the first driving pulse DPa. More specifically, an electric potential difference Vdb between the second contraction electric potential VLb, which is a minimum electric potential of the second driving pulse DPb, and the second expansion electric potential VHb, which is a maximum electric potential of the second driving pulse DPb is set such that the electric potential difference Vdb is larger than an electric potential difference Vda between the first contraction electric potential VLa, which is a minimum electric potential of the first driving pulse DPa, and the first expansion electric potential VHa, which is a maximum electric potential of the first driving pulse DPa. Through this method, the supply of the second driving pulse DPb to the piezoelectric potential 48 makes an amount of a single ink droplet discharged through the nozzle 63 larger. Thus, when causing the first driving pulse DPa to drive the piezoelectric element 48 to discharge an ink through a nozzle 63 a predetermined number of times and causing the second driving pulse DPb to drive the piezoelectric element 48 to discharge an ink through the same nozzle 63 the same predetermined number of times, a per-unit-time discharge amount in the case of the first driving pulse DPa is smaller than that in the case of the second driving pulse DPb. Here, the per-unit-time discharge amount means an amount which is obtained for each of the nozzles 63 by accumulating a period of time during which an ink has been discharged through the each of the nozzles 63 and dividing a total amount of the ink having been ejected during the accumulated periods of time by the accumulated periods of time. In addition, the above period of time during which an ink has been discharged through each of the nozzles 63 is equivalent to, for example, a time interval which is one of periodic time intervals at each of which a relevant driving pulse is generated by the driving signal generation circuit 82, and during which the relevant driving pulse has been actually supplied to a piezoelectric element 48 corresponding to the each of the nozzles 63, thereby having caused an ink to be discharged through the each of the nozzles 63. In the case where, through each of the nozzles 63, a corresponding ink is ejected by using the same kind of driving pulse, a per-unit-time discharge amount of the ink ejected through the each of the nozzles 63 results in approximately the same as that of an ink ejected through any other one of the nozzles 63.

In this embodiment, subsequent to the selection of the initial discharge mode in step S2 described above, flushing processing is performed (step S3). This flushing processing is processing for causing the carriage 10 to move to a position above the capping mechanism 13 provided at the home position and, under this condition, causing each of inks to be discharged toward the cap 15 a predetermined number of times through a corresponding one of all the nozzles 63. That is, the flushing processing is processing for carrying out preliminary ejection operations. In the flushing processing, the inks are discharged by using the first driving pulse DPa. Through this method, an ink which is to be discharged first from an ink cartridge 17 having been newly attached and which has the highest viscosity, that is, an ink having the highest possibility of causing a discharge failure, is evacuated into the cap 15. Further, through this flushing processing, a flow arises in an ink contained in the ink cartridge 17, and thus, the equalization of concentration and viscosity of the ink is promoted by the flow of the ink.

Subsequent to completion of the predetermined number of discharge operations of the inks (i.e., subsequent to completion of the discharge operations of a predetermined amount of the inks), the process flow proceeds to printing processing under a situation where the initial discharge mode is maintained as it is (step S4). That is, images or the like are printed on recording paper or the like transported to a position above the platen 9 by causing the first driving pulses DPa to drive the piezo electric elements 48 to discharge inks through the nozzles 63. In addition, in this embodiment, description is made by way of an example in which driving pulses for use in the flushing processing performed in the initial discharge mode and driving pulses for use in the printing processing which is performed in the initial discharge mode likewise are the first driving pulses DPa, but the above two kinds of driving pulses are not necessarily the same. What matters is that a kind of the driving pulses for use in the flushing processing and a kind of the driving pulses for use in the printing processing may be different from each other, provided that each of these two kinds of driving pulses causes inks each having a smaller per-unit-time discharge amount to be discharged, as compared with a case of a kind of driving pulse for use in the printing processing performed in the normal discharge mode.

In the printing processing performed in the initial discharge mode, inks are discharged by using the first driving pulses DPa, and thus, a per-unit-time discharge amount for each of the nozzles 63 is suppressed. Through this method, even when, immediately after an ink cartridge 17 has been newly attached, an ink being contained in the ink cartridge 7 and having a relatively high viscosity is discharged, a degree of a lack of an amount of the ink to be fed to corresponding nozzles 63 is suppressed, thereby enabling the occurrence of a discharge failure to be reduced. Further, similarly to the flushing processing, in the printing processing performed in the initial discharge mode, a flow arises in the ink contained in the newly attached cartridge 17, and thus, the equalization of concentration and viscosity of the ink are promoted. Here, in this printing processing, the CPU 79 accumulates an amount of an ink which is discharged through each of all the nozzles 63 in the initial discharge mode (including an amount of an ink which is discharged through each of all the nozzles 63 in the flushing processing), and the CPU 79 determines whether or not the accumulated amount (in another ward, a total discharge amount) reaches a predetermined prescribed amount (step S5, which corresponds to the above third process in the second aspect of the invention). In the case where the CPU 79 has determined that the total discharge amount does not reach the prescribed amount (in the case of "No"), the process flow is returned to step S4, and the printing processing in the initial discharge mode is continuously performed.

In contrast, in the case where the CPU 79 has determined that the total discharge amount has reached the prescribed amount (in the case of "Yes"), the CPU selectively switches the initial discharge mode to the normal discharge mode (step S6, which corresponds to the above fourth process in the second aspect of the invention), and the printing processing is continuously performed (step S7). Through this switching, thereafter, the second driving pulses DPb are used in operations of discharging inks until a next replacement of an ink cartridge 17. When the total discharge amount has reached the prescribed amount, the ink contained in the newly attached ink cartridge 17 has entered a state in which the viscosity of the ink is stable, that is, a state in which a gradient of viscosity of the ink and a gradient of concentration of the ink have been eliminated and the viscosity of the ink has reached a viscosity supposed in specification for the printer 1 (or a viscosity approximately equal thereto), and thus, it is possible to discharge inks through the nozzles 63 without any problem, that is, without any possibility of causing a discharge failure due to the high viscosity of the ink. Further, the CPU 79 determines whether or not the printing processing has been completed (that is, whether or not a series of print jobs based on a set of print data have been completed), and in the case where the CPU 79 has determined that the printing processing is not yet completed (in the case of "No"), the process flow returns to step S7, and the printing processing in the normal discharge mode is continuously performed. In contrast, in the case where, in step S8, the CPU 79 has determined that the series of print jobs based on the set of print data have been completed (in the case of "Yes"), the process flow terminates.

As described above, in the printer 1 according to this embodiment of the invention, the initial discharge mode is set during a period from an event where an ink cartridges 17 is newly attached until an event where a total discharge amount of inks reaches a prescribed amount, and upon satisfaction of a condition in that the total discharge amount reaches the prescribed amount, the initial discharge mode is switched to the normal discharge mode. Thus, a per-unit-time discharge amount is suppressed in the printing processing performed in the initial discharge mode, and even when, immediately after an ink cartridge 17 has been newly attached, an ink being contained in the ink cartridge 7 and having a relatively high viscosity is discharged, a degree of a lack of an amount of the ink to be fed to corresponding nozzles 63 is suppressed, thereby enabling the occurrence of a discharge failure to be reduced. As a result, it becomes possible to prevent the degradation of an image quality of a printed image or the like.

Further, in this embodiment, the printing processing is also performed in the initial discharge mode (that is, printing processing is performed using inks whose initial contraction/viscosity is relatively high), and thus, the number of discharge operations (i.e., an amount of discharged inks) is suppressed in the flushing processing performed prior to the printing processing, thereby enabling unnecessary consumption of the inks to be reduced. Thus, it is possible to deal with downsizing of the printer 1 by employing ink cartridges 17 each being downsized and having a relatively small ink-storage capacity.

In addition, in the aforementioned embodiment, a configuration, in which, under a situation where the initial discharge mode is set, after processing has proceeded to the printing processing subsequent to completion of the flushing processing, upon satisfaction of a condition in that a total discharge amount reaches a prescribed amount, the initial discharge mode is switched to the normal discharge mode, has been exemplified, but the configuration is not limited to this configuration. The configuration may be made such that, for example, even before the flushing processing proceeds to the printing processing, upon satisfaction of a condition in that a total discharge amount reaches a prescribed amount during execution of the flushing processing, the initial discharge mode is switched to the normal discharge mode.

Hereinafter, evaluations of the printer 1 having such a manner as described above will be described. In addition, this description will be made by using a comparison example in which a configuration is made such that, after detection of attachments of the ink cartridges 17, the discharge of inks is performed in the normal discharge mode without performing the processes in steps S2 to S4 of this embodiment (that is, without selecting the initial discharge mode).

Evaluation 1 "Evaluation in View of Accuracy of Land Position"

After having performed the processes in steps S1 to S4 in this embodiment; while, in the comparison example, without performing the processes in steps S2 to S4 after having performed the process in step S1, ten thousands successive operations of discharging ink droplets through each of the nozzles 63 of the recording head 3 were carried out in the normal discharge mode. In addition, the predetermined prescribed amount compared with the total discharge amount in step S4 of this embodiment was set to 0.08 grams. With respect to the ten thousands ink droplets having been discharged through a predetermined nozzle 63 which is located in a center portion of the nozzle rows, an average value of misalignment amounts d is calculated, and an evaluation was made by determining to which of the following three ranges, which are predetermined ranges of the average values of the misalignment amounts, each of resultant average values belongs. In addition, the misalignment amount d is a misalignment amount of a central position of a landed ink droplet relative to a target central position of the landed ink droplet, (that is, relative to the center of a target land position of an ink droplet in a state in which any ink flight deflection or the like does not occur).

Range A1: a resultant average value of the misalignment amounts d is smaller than 0.05 micrometers.

Range B1: a resultant average value of the misalignment amounts d is larger than or equal to 0.05 micrometers and smaller than 0.10 micrometer.

Range C1: a resultant average value of the misalignment amounts d is larger than or equal to 0.10 micrometers.

As a result, a resultant average value of the misalignment amounts d in the case of this embodiment belonged to the range A1; while a resultant average value of the misalignment amounts d in the case of the comparison example belonged to the range C1. That is, a result of this evaluation was such that: in the configuration in which the processes in steps S2 to S4 were not performed, the misalignment amounts of the landed ink droplets became larger because, due to influence of a relatively high viscosity of each of inks being in an initial stage after the attachment of the ink cartridges 17, the feed of inks to the nozzles 63 could not catch up an amount of inks to be fed thereto and thereby a meniscus inside each of the nozzles 63 was not stable.

Evaluation 2 "Evaluation in View of Stability of Discharge Amount of Ink Droplet"

Ten thousands ink droplets were successively discharged though two nozzles 63 each located in a corresponding one of edges of a nozzle row of the recording head 3. Further, for each of the two nozzles 63, a total weight of the discharged ink droplets was obtained, and an average discharge amount was calculated by dividing the obtained total weight by the total number of the discharge operations. Subsequently, an absolute value ΔW (expressed in nanograms) of a difference between the two calculated average discharge amounts was obtained. Further, a ratio of this absolute value ΔW relative to a target discharge amount WT (expressed in nanograms) of a discharged ink droplet (i.e., a ratio ΔW/WT) was calculated, and an evaluation was made according to three reference ranges described below. It can be said that the smaller a ratio ΔW/WT is, the more superior the stability of the discharge amount of a discharged ink droplet is (that is, the smaller a variation of the discharge amount of a discharged ink droplet relative to a target discharge amount of the discharged ink droplet is).

Range A2: a ratio ΔW/WT is smaller than 0.025.

Range B2: a ratio ΔW/WT is larger than or equal to 0.025 and smaller than 0.625.

Range C2: a ratio ΔW/WT is larger than or equal to 0.625.

A result of this evaluation was such that: a resultant ratio ΔW/WT in the case of this embodiment belonged to the range A2; while a resultant ratio ΔW/WT in the case of the comparison example belonged to the range C2.

Evaluation 3 "Evaluation in View of Image Quality"

For each of this embodiment and the comparison example, two vertical straight lines having a distance of 200 millimeters therebetween were printed such that the two vertical straight lines intersect with (ideally, orthogonally intersect with) the main-scanning direction of the carriage 10, and an average value of variation amounts in the main-scanning direction, each of the variation amounts being associated with a position of a corresponding one of dots constituting each of the two vertical straight lines, was evaluated.

Range A3: an average value of variation amounts is smaller than or equal to 20 micrometers.

Range B3: an average value of variation amounts is smaller than or equal to 40 micrometers.

Range C3: an average value of variation amounts is larger than or equal to 60 micrometers.

A result of this evaluation was such that: a resultant average value of variation amounts in the case of this embodiment belonged to the range A3; while a resultant average value of variation amounts in the case of the comparison example belonged to the category C3.

In addition, in the aforementioned embodiment, the piezoelectric element 48 of a so-called vertical oscillation type has been described as an example of an actuator which is a driving source of operations of discharging an ink, but the actuator is not limited to such a piezoelectric element, and an actuator of a different type, such as a so-called electrostatic type actuator which causes displacement of a portion of a pressure chamber by using electrostatic forces, or a heater element which causes air bubbles to arise in a liquid by means of heating so that the air bubbles cause a variation of pressure inside the pressure chamber.

Further, hereinbefore, the printer 1 including the recording head 3 of an ink jet head type has been described as an example of the ink jet printer according to the first aspect of the invention, but the invention is not limited to such an ink jet printer of an ink jet head type, and can be also applied to an ink jet printer of a different type, in which an ink cartridge of a so-called foam type is used. The invention can be also applied to, for example, a display manufacturing printer which is for use in manufacturing color filters for a liquid crystal display and the like, and which includes a color material ejection head mounted therein; an electrode manufacturing printer which is for use in forming electrodes for an organic electro luminescence (EL) display, a face emitting display (FED) and the like, and which includes an electrode material ejection head mounted therein.

What is claimed is:

1. An ink jet printer comprising:

an attachment detection portion that detects an attachment of an ink storage member that retains an ink in an absorber contained in the ink storage member itself;

an ink jet recording head that ejects an ink flown in from the ink storage member; and a control circuit that controls ink ejection performed by the ink jet recording head, wherein the control circuit is configured to, upon detection, by the attachment detection portion, of an attachment of the ink storage member to be newly used, perform control so as to cause a first operation mode to be set, and thereafter, perform control so as to cause the first operation mode to be switched to a second operation mode, upon satisfaction of a condition in that a total discharge amount of an ink ejected in the first operation mode reaches a prescribed amount, and wherein a per-unit-time discharge amount of an ink ejected in the first operation mode is set so as to be smaller than a per-unit-time discharge amount of an ink ejected in the second operation mode.

2. A control method for an ink jet printer provided with an ink jet recording head, to which an ink storage member that retains an ink in an absorber contained in the ink storage member itself is attached, and which ejects an ink flown in from the ink storage member, the control method comprising:

a first process of detecting an attachment of the ink storage member to be newly used;

a second process of setting a first operation mode;

a third process of detecting a satisfaction of a condition in that a total discharge amount of an ink ejected in the first operation mode reaches a prescribed amount; and a fourth process of switching the first operation mode to a second operation mode upon detection of the satisfaction of the condition in the third process, wherein a per-unit-time discharge amount of an ink ejected in the first operation mode is set so as to be smaller than a per-unit-time discharge amount of an ink ejected in the second operation mode.

* * * * *